US006692083B2

(12) United States Patent
Latham

(10) Patent No.: US 6,692,083 B2
(45) Date of Patent: Feb. 17, 2004

(54) REPLACEABLE WEAR SURFACE FOR BIT SUPPORT

(75) Inventor: Winchester E. Latham, Avon, IN (US)

(73) Assignee: Keystone Engineering & Manufacturing Corporation, Avon, IN (US)

( * ) Notice: Subject to any disclaimer, the term of this patent is extended or adjusted under 35 U.S.C. 154(b) by 0 days.

(21) Appl. No.: 10/171,939

(22) Filed: Jun. 14, 2002

(65) Prior Publication Data

US 2003/0230927 A1 Dec. 18, 2003

(51) Int. Cl.[7] ..... E21C 35/18; E21C 35/183; F16B 39/10; F16B 43/02

(52) U.S. Cl. ..... 299/104; 299/106; 411/119; 411/533; 411/531

(58) Field of Search ..... 175/413; 299/102, 299/103, 104, 106, 107; 411/531, 533, 119–121, 197

(56) References Cited

U.S. PATENT DOCUMENTS

| | | | | | |
|---|---|---|---|---|---|
| 3,512,838 | A | * | 5/1970 | Kniff | 299/104 |
| 3,746,396 | A | | 7/1973 | Radd | |
| 4,284,114 | A | * | 8/1981 | Korenobu | 411/119 |
| 4,380,413 | A | * | 4/1983 | Dewey | 411/161 |
| 4,489,986 | A | | 12/1984 | Dziak | |
| 4,781,503 | A | * | 11/1988 | Bogel | 411/368 |
| 4,844,550 | A | * | 7/1989 | Beebe | 299/107 |
| 4,932,723 | A | | 6/1990 | Mills | |
| 4,981,373 | A | * | 1/1991 | Bando | 384/620 |
| 5,098,167 | A | | 3/1992 | Latham | |
| 5,106,166 | A | | 4/1992 | O'Neill | |
| 5,273,343 | A | | 12/1993 | Ojanen | |
| 5,599,131 | A | * | 2/1997 | Julen et al. | 403/312 |
| 5,628,549 | A | | 5/1997 | Ritchey et al. | |
| 5,730,502 | A | | 3/1998 | Montgomery, Jr. | |
| 5,842,747 | A | | 12/1998 | Winchester | |
| 5,884,979 | A | | 3/1999 | Latham | |
| 5,931,542 | A | | 8/1999 | Britzke et al. | |
| 5,967,673 | A | * | 10/1999 | Kenney et al. | 384/620 |
| 6,073,965 | A | * | 6/2000 | Kinoshita et al. | 280/775 |
| 6,113,195 | A | | 9/2000 | Mercier et al. | |
| 6,164,728 | A | | 12/2000 | Sollami | |
| 6,199,956 | B1 | | 3/2001 | Kammerer | |
| 6,357,832 | B1 | | 3/2002 | Sollami | |
| 6,371,567 | B1 | | 4/2002 | Sollami | |
| 6,375,272 | B1 | | 4/2002 | Ojanen | |
| 6,378,952 | B1 | | 4/2002 | Moosmann et al. | |
| 6,390,352 | B1 | | 5/2002 | Sollami | |
| 6,454,360 | B1 | | 9/2002 | Monyak | |
| 6,478,383 | B1 | | 11/2002 | Ojanen et al. | |
| 6,508,516 | B1 | | 1/2003 | Kammerer | |

* cited by examiner

*Primary Examiner*—David Bagnell
*Assistant Examiner*—Shane Bomar
(74) *Attorney, Agent, or Firm*—Brinks Hofer Gilson & Lione

(57) ABSTRACT

A cutter assembly includes a cutting bit, a replacable wear surface in the form of a washer, and a sleeve. The cutting bit has a forward cutting tip, a rearward extending shank adapted to be received in a tool holder, and a rearward facing shoulder. The sleeve surrounds the shank and includes a forward edge. The washer includes a central hole receiving the cutting bit shank, a front surface and a back surface joined by an outer asymmetrical edge of angularly variable radius. A portion of the washer front surface is in sliding contact with the rearward facing bit shoulder. The washer back surface includes a lip extending rearward from only a segment of the asymmetric edge for engaging an outer shoulder of a holder to inhibit rotation of the washer relative to the holder.

17 Claims, 3 Drawing Sheets

REPLACEABLE WEAR SURFACE FOR BIT SUPPORT

BACKGROUND OF THE INVENTION

The present invention relates generally to road milling and trenching machines and more particularly to apparatus for preventing wear on the face of blocks or holders that are used for retaining cutting bits on such road milling, trenching and other machines.

Conventional road milling and trenching machines utilize cutting bits mounted in cutting systems that in normal operations move with respect to a work surface. The cutting systems typically include a plurality of cutting bit holders or blocks that include a bore. Each of the cutting bits includes a cutting surface located at a forward or distal end of the cutting bit that is intended to contact the work surface to mill or mine material from the work surface. Each of the cutting bits also includes a shank located at a rearward or proximal end of the cutting bit that is received in a bore in a cutting bit holder or block.

During use, impacts between the cutting bits and the work surface cause the cutting bits to rotate with respect to the holder. The impact induced rotation also causes relative movement between confronting surfaces of the cutting bit and holder. The environment in which such machines are typically operated generally includes abrasive particulate materials that are displaced from the work surface and can be entrained between the confronting surfaces of the cutting bit and holder. The relative movement in the presence of the abrasive particulate materials causes significant frictional wear that can result in a variety of failure modes for the cutting system.

Attempts have been made to focus the wear on cutting system elements that are easily replaced, such as the cutting bits, rather than on the system elements that are more or less permanent portions of the cutting system, such as the cutting bit holders. For example, the cutting bit shank is typically rotatably mounted within a sleeve that is received within the bore of the cutting bit holder. Preferable the sleeve is sized so that it tightly grips or engages the bore of the cutting bit holder and does not rotate with respect to the holder. In this way, the frictional wear occurs on the confronting surfaces of the sleeve and bit shank, both of which are easily replaced. The conventional sleeves do nothing to protect other confronting surfaces of the cutting bit and bit holder. As a result, excessive wear occurs on the face of the cutting bit holder or block into which the cutting bit shank extends. After prolonged use, the wear on the face of the holder or block can become severe enough to require its replacement.

Several attempts have been made to alleviate this problem. Beebe, U.S. Pat. No. 4,561,698, discloses a sleeve and wear protector including an annular flange manufactured as a unitary wear protector. The unitary wear protector is manufactured of materials such that it wears at a rate substantially coincident with the wear rate of the cutting bit. However, the unitary wear protector may rotate within the bore, thus leading to uneven wear of the protector assembly and wear of the holder or block. Dziak, U.S. Pat. No. 4,489,986, discloses refers to a retainer element mounted on a cylindrical shank of a cutter bit. The cutter bit is mounted within a bore of a holder or block member. The holder or block member includes a cylindrical outer portion including a groove in which is mounted a rubber or plastic ring. The ring is received in another groove within a wear collar that contacts the cutter bit. The rubber or plastic ring further is symmetric about the axis of the cutter bit, and no means is provided to inhibit relative rotation between the collar and the holder or block member. Mercier et al., U.S. Pat. No. 6,113,195, discloses a washer disposed between the holder and the cutting bit that is conical (Belleville) so that the washer makes annular line contact with a shoulder of the cutting bit, and with an edge of the bore of the holder, in order to effectively seal out abrasive fines from the bore and thereby reduce the unwanted wear. No provision is made to inhibit rotation of the washer of Mercier et al, thus resulting in significant wear of the holder surface facing the washer.

O'Neill, U.S. Pat. No. 5,106,166, discloses a unitary sleeve that has a bore for rotatably receiving a cutting bit. The sleeve and holder or block are constructed such that the angular position of the sleeve can be fixed relative to the axis of the aperture in the sleeve in any one of a plurality of discrete positions. The sleeve and holder are constructed such that the sleeve can later be rotated with respect to the axis of the aperture in the holder or block to another position and then fixed in that position. While the construction of O'Neill prevents unwanted wear of the forward facing surface of the block or holder, it requires that the block or holder have specific features not commonly present on most blocks or holders in general use. Thus, the unitary sleeve of O'Neill is cannot be used to reduce the wear of most blocks or holders in general use today. Britzke et al, U.S. Pat. No. 5,931,542, discloses a substantially circular wear washer with a radially inwardly directed key which is adapted to fit within a slot in a sleeve surrounding the shank of the cutting bit, thereby interlocking the sleeve and the wear washer. The holder or block bore includes a keyway which is engaged a radially outwardly directed key on the sleeve thereby interlocking the retainer sleeve and wear washer with the holder or block. In the absence of such a keyway on the interior bore of the holder or block, the sleeve and washer are free to rotate. Thus Britzke et al, like O'Neill, requires that the block or holder have specific features not commonly present on most blocks or holders in general use.

What is needed is a wear washer, which is adaptable for use on a wide variety of existing holder or blocks that will inhibit or prevent wear of the forward facing surface of the holder or block. Preferably the wear washer can be coupled to a wide variety of conventional cutter bits so that it can be replaced with each replacement of the cutter bit.

SUMMARY OF THE INVENTION

Accordingly, a cutter tool has a tool holder and a cutting bit as well as a washer of the present invention. The tool holder includes a holder surface having a bore extending rearward through the holder surface and an outer edge spaced from the bore. The cutting bit includes a body having a front cutting tip, a rearward projecting shank rotatably mounted in the bore of the tool holder, and a rearward facing bit shoulder disposed at a front end of the shank. The shank is rotationally symmetric about a longitudinal axis of the cutting bit. The washer is disposed between the bit shoulder and the holder surface. The washer comprises a front surface in sliding engagement with the bit shoulder, and a back surface contacting the holder surface. The back surface includes an axially asymmetric lip engaging the holder surface outer edge so as to inhibit rotation of the washer relative to the holder surface.

The cutting bit and washer can be assembled together to form a cutter assembly of the present invention. The washer includes an inner edge defining a central hole receiving the cutting bit shank. The washer also includes a front surface and a back surface joined by an outer edge of angularly variable radius. The front surface includes at least a portion for sliding contact with the rearward facing bit shoulder. The back surface includes a lip extending rearward from only a segment of the asymmetric edge for engaging an outer shoulder of a holder. The lip can be a linear rearward extension along an outer edge of the back surface of the washer. Where the washer outer edge is in the form of an ellipse, the lip can also be positioned on the back surface of the washer on a major axis of the ellipse. A sleeve surrounding the cutting bit shank includes a forward edge positioned to confront the back surface of the washer adjacent the inner edge for retaining the washer on the cutting bit adjacent to the rearward facing bit shoulder. The washer central hole includes a smooth inner surface that facilitates rotation of the cutting bit relative to the washer.

The portion of the washer in sliding contact with the rearward facing bit shoulder is generally a circular ring portion. In one embodiment, the washer front surface includes an outer tapered portion tapering away from the circular ring portion. In another embodiment, the washer front surface also includes an inner tapered portion, and both tapered portions taper away from the circular line portion in sliding contact with the rearward facing bit shoulder. The outwardly tapered surface tends to inhibit particulate abrasive material from penetrating passed the circular ring contact portion, and thus concentrates any frictional wear into a circular pattern on the rearward facing bit shoulder and the forward facing surface of the washer. Thus, the tool holder forward surface and the tool holder bore experience reduced wear, which contributes to enhanced usable life for the tool holder and more reliable positioning of the cutting bit in relation to the work surface.

These and other features and advantages of the present invention will become apparent from the following description of illustrative embodiments of the present invention. The description makes reference to the accompanying drawings.

DESCRIPTION OF PREFERRED EMBODIMENTS

Figure 1:
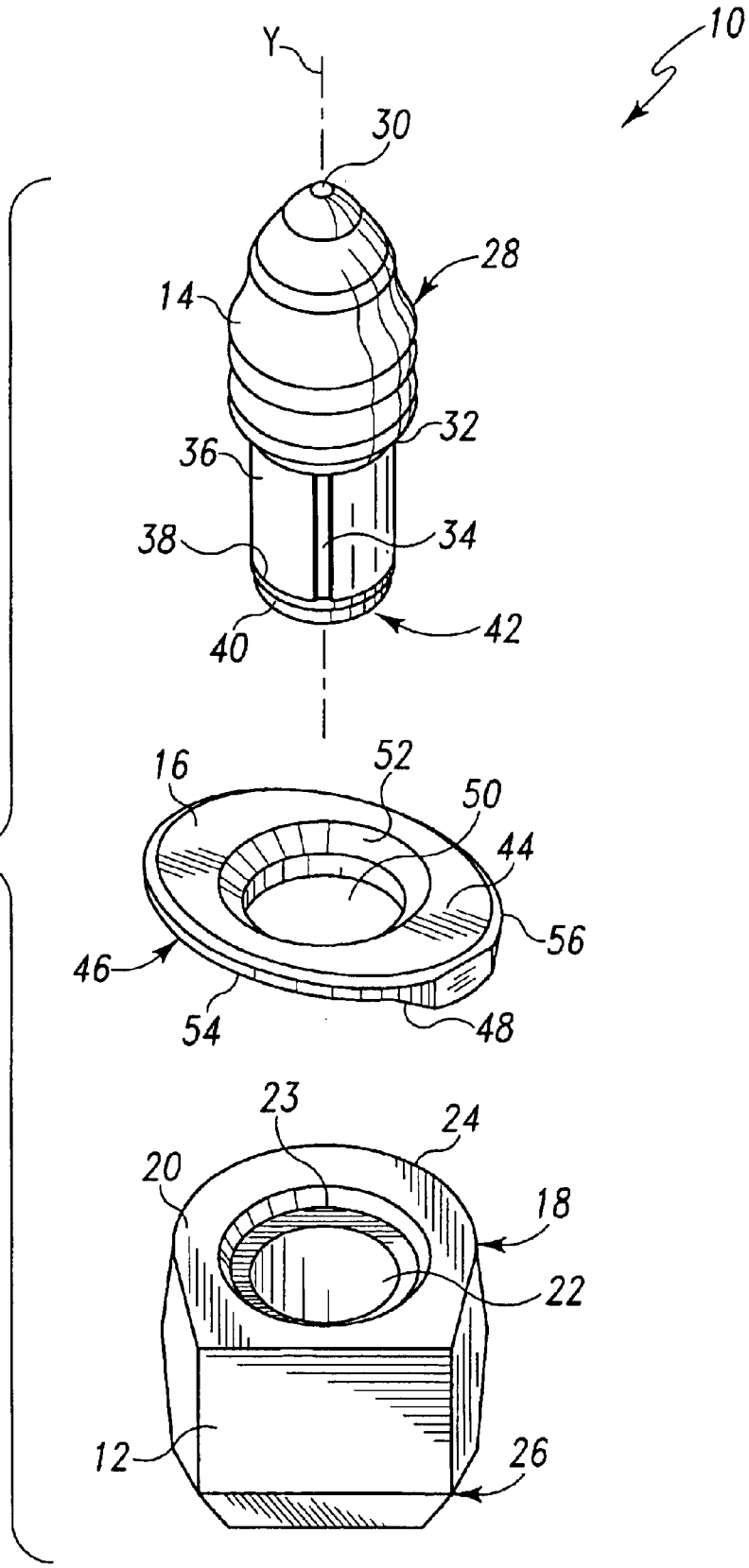
FIG. 1 is an exploded view of a cutter tool including a tool holder and a cutting bit as well as a washer of the present invention.

FIG. 1 illustrates one embodiment of a cutter tool 10 of the present invention. The cutter tool 10 includes a tool holder 12, a cutting bit 14 and a washer 16. The tool holder 12 includes a body 18 having a holder surface 20. The body 18 includes a bore 22 extending through the holder surface 20 and body 18. The bore 22 can include a beveled or chamfered portion 23. An outer edge 24 is spaced from the bore 22 typically by a distance that varies around the perimeter of the body 18. The tool holder 12 is generally secured to other apparatus, such as a milling drum (not shown), by a weld around the bottom perimeter 26.

The cutting bit 14 includes a body 28 having a front cutting tip 30 and a rearward facing shoulder 32. Any number of flutes and scallops may be present on the outer surface of the body 28 between the tip 30 and the rearward facing shoulder 32. A shank portion 34 projects rearward from the center of the rearward facing shoulder 32. The shank portion 34 can be seen to be rotationally symmetric about a longitudinal axis Y of the cutting bit 14. A sleeve 36, typically constructed of a spring steel, surrounds the cutting bit shank portion 34 and is held on to the shank portion 34 by a rearward edge 38 of the sleeve 36 confronting a radially protruding lip 40 adjacent the rear end 42 of the shank portion 34. The sleeve 36 has an outer diameter equal to or slightly exceeding the inner diameter of the bore 22 so as to be tightly received therein. The sleeve 36 has an inner diameter that is greater than the diameter of the shank portion 34 so as to fit somewhat loosely thereon. The cutting bit 14 is thus able to rotate with respect to the sleeve 36 and the tool holder 12 when the shank portion 34 of the cutting bit 14 is received in the bore 22 of the tool holder 12.

The washer 16 is disposed between the cutting bit rearward facing shoulder 32 and the tool holder surface 20. The washer 16 includes a front surface 44 in sliding engagement with the bit rearward facing shoulder 32. A back surface 46 of the washer 16 contacts the tool holder surface 20. The back surface 46 includes an axially asymmetric lip 48 for engaging the outer edge 24 of the tool holder 12 so as to inhibit rotation of the washer 16 relative to the tool holder surface 20. The washer 16 includes a smooth inner bore 50 that facilitates rotation of the cutting bit 14 relative to the washer 16. The inner bore 50 is surrounded by an axially symmetric sloping or tapered portion 52 that is received in the beveled or chamfered portion 23 of the tool holder 12 surrounding the bore 22. The diameter of the bore 50 is preferably slightly smaller than the outside diameter of sleeve 36. A perimeter surface 54 connects an outwardly tapered portion 56 of the front surface 44 to the back surface 46. The perimeter surface 54 is of varying radius measured from the center of the bore 50, which is coincident with the axis Y of the cutting bit 14.

Figure 2:
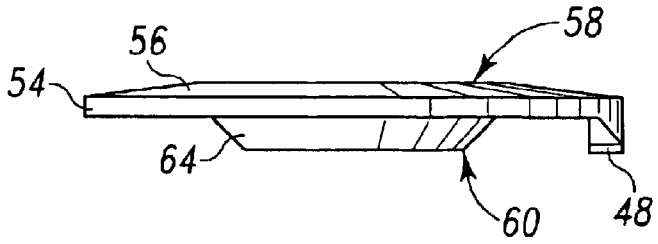
FIG. 2 is a side elevation view of a washer of the present invention.
Figure 3:
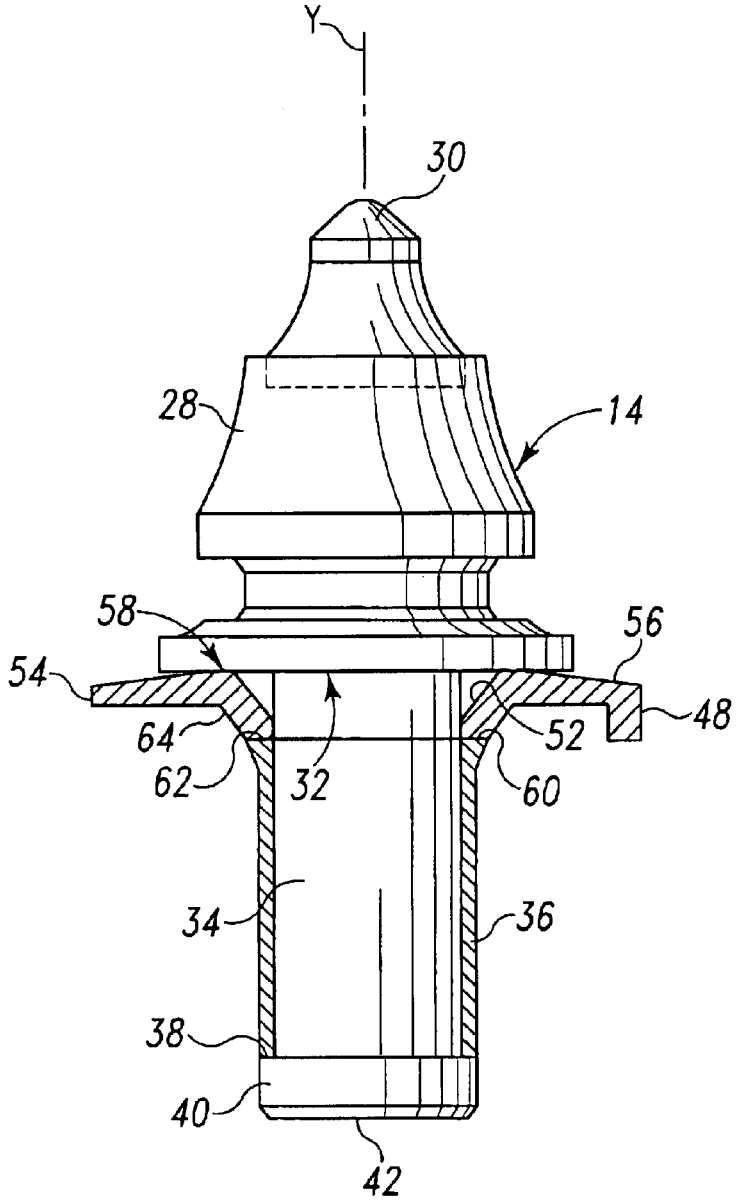
FIG. 3 is a side elevation view of a cutting bit and washer assembly of the present invention, the washer and sleeve being shown in section.

In the embodiment illustrated in FIGS. 2 and 3, the outwardly tapered portion 56 is seen to extend over a greater fraction of the washer 16 than the inwardly tapered portion 52. The washer front surface 44 is also seen to have a circular ring portion 58 between the inner tapered portion 52 and the outwardly tapered portion 56 that is in sliding contact with the rearward facing bit shoulder 32. This larger outwardly tapered portion 56 acts to direct abrasive particulate matter away from the ring portion 58, thus reducing the rate of wear experienced by the washer 16 and bit 14. The back surface 46 also includes an inner edge 60 that is in contact with a forward facing edge 62 of the sleeve 36, thereby retaining the washer 16 and cutting bit 14 together as an easily handled combination. The back surface 46 also includes a tapered portion 64 that is adapted to be received in the beveled or chamfered portion 23 commonly found in a typical holder 12.

Figure 4A:
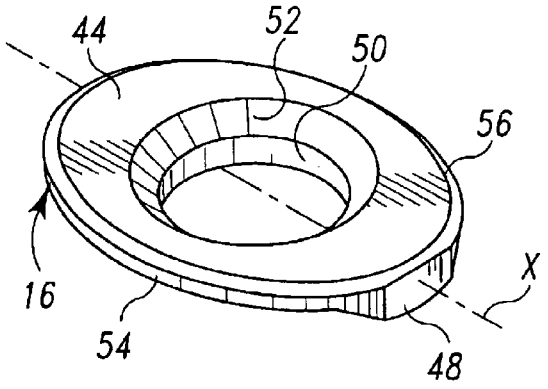
FIGS. 4A and 4B are perspective views of the top and bottom of one embodiment of a washer of the present invention.
Figure 4B:
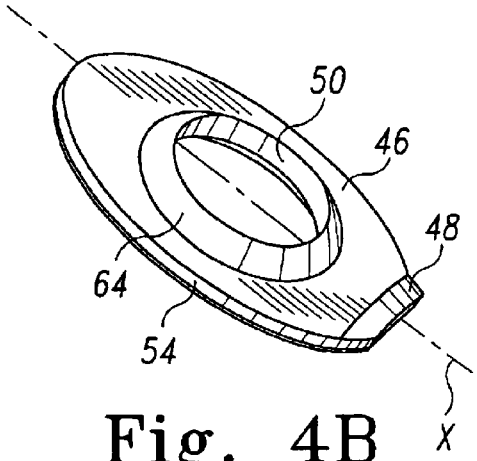
Figure 5A:
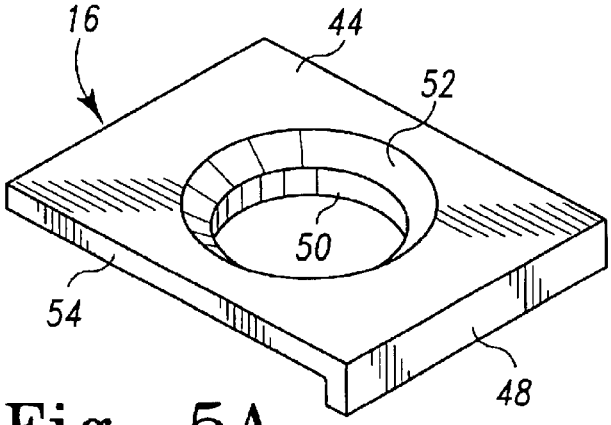
FIGS. 5A and 5B are perspective views of the top and bottom of another embodiment of a washer of the present invention.
Figure 5B:
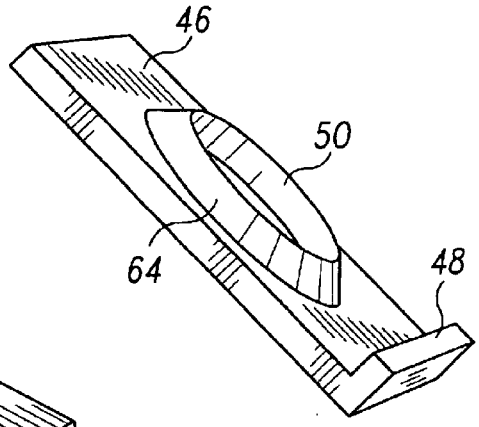
Figure 6:
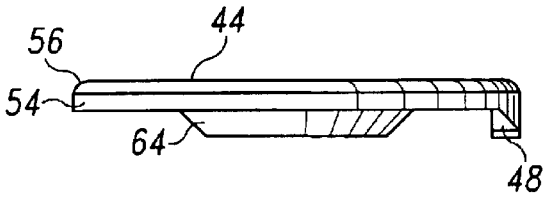
FIG. 6 is a side elevation view of the washer of FIGS. 4A and 4B.

The perimeter surface 54 of the washer 16 can assume a number of shapes that are suitable for use in the present invention. FIGS. 4A and 4B show a washer 16 with an outer edge 54 in the form of an ellipse. The lip 48 is positioned on the back surface 46 of the washer 14 on a major axis X of the ellipse. In FIGS. 5A and 5B, the washer 16 is shown to have a rectangular outer perimeter surface 54. The lip 48 is seen to have the form of a linear rearward extension along an outer edge of the back surface 46 of the washer 16. Other perimeter shapes that can be employed for the present invention will be apparent to those skilled in the art based on the forgoing examples. In each situation the perimeter surface 54 is seen to be of varying radius measured from the center of the bore 50. Further the area of the forward surface 44 in contact with the rearward facing bit shoulder 32 can be varied so as occupy a smaller portion as in FIGS. 2 and 3, or a larger portion as in FIGS. 4–6 wherein the forward surface 44 is substantially planar and having only a very minor outwardly tapered portion 56. Although the present invention has been described in connection with preferred embodiments thereof, it will be appreciated by those skilled in the art that additions, deletions, modifications, and substitutions not specifically described can be made without departing from the spirit and scope of the invention as defined in the appended claims.

What is claimed is:

1. A cutter tool comprising:

a tool holder including a holder surface having a bore extending rearward through the holder surface and an outer edge spaced from the bore;

a cutting bit including a body having a front cutting tip, a rearward projecting shank rotatably mounted in the bore, and a rearward facing bit shoulder disposed at a front end of the shank; the shank being rotationally symmetric about a longitudinal axis of the cutting bit, a washer disposed between the bit shoulder and the holder surface, the washer comprising a front surface in sliding engagement with the bit shoulder, and a back surface contacting the holder surface, the back surface including an axially asymmetric lip engaging the holder surface outer edge so as to inhibit rotation of the washer relative to the holder surface and an axially symmetric tapered surface engaging a tapered portion of the tool holder bore, the front surface including an outer tapered portion and an inner tapered portion, both tapered portions tapering away from a circular line in sliding contact with the rearward facing bit shoulder, the outer tapered portion directing abrasive particulate matter away from the circular line.

2. The cutter tool of claim 1 further comprising a sleeve surrounding the cutting bit shank including a forward edge confronting the back surface of the washer to retain the washer on the cutting bit adjacent to the rearward facing bit shoulder.

3. The cutter tool of claim 2 wherein the washer includes a smooth inner bore facilitating rotation of the cutting bit relative to the washer.

4. The cutter tool of claim 1 wherein the lip comprises a linear rearward extension along an outer edge of the back surface of the washer.

5. The cutter tool of claim 1 wherein the washer outer edge is in the form of an ellipse, and the lip is positioned on the back surface of the washer on a major axis of the ellipse.

6. The washer of claim 1 wherein the outer tapered portion is larger than the inner tapered portion.

7. A cutter assembly comprising a cutting bit and a washer, the cutting bit comprising a body forming a forward cutting tip, a rearward extending shank, and a rearward facing bit shoulder disposed at a forward end of the shank; the shank being rotationally symmetric about a longitudinal axis of the cutting bit, the washer including an inner edge defining a central hole receiving the cutting bit shank, a front surface and a back surface joined by an outer edge of angularly variable radius in the form of an ellipse, the front surface including at least a portion for sliding contact with the rearward facing bit shoulder, and the back surface including a lip extending linearly rearward from only a segment of the asymmetric edge on a major axis of the ellipse for engaging an outer shoulder of a holder to inhibit rotation of the washer relative to the holder and an axially symmetric tapered surface immediately surrounding the central hole for engaging a tapered portion of a bore in the holder.

8. The cutter assembly of claim 7 further comprising a sleeve surrounding the cutting bit shank including a forward edge positioned to confront the back surface of the washer adjacent the inner edge for retaining the washer on the cutting bit adjacent to the rearward facing bit shoulder.

9. The cutter assembly of claim 8 wherein the washer central hole includes a smooth inner surface facilitating rotation of the cutting bit relative to the washer.

10. The cutter assembly of claim 7 wherein the portion of the washer in sliding contact with the rearward facing bit shoulder comprises a circular ring portion, and wherein the washer front surface includes an outer tapered portion tapering away from the circular ring portion.

11. The cutter assembly of claim 10 wherein the washer front surface further includes an inner tapered portion, both tapered portions tapering away from the circular line portion in sliding contact with the rearward facing bit shoulder.

12. The washer of claim 11 wherein the outer tapered portion is larger than the inner tapered portion.

13. A washer comprising a front surface and a back surface, an inner edge connecting the front and back surfaces and defining a central hole about an axis passing through the central hole, an outer asymmetric edge of angularly variable radius from the axis in the form of an ellipse, the edge connecting the front and back surfaces, the back surface including a lip extending linearly rearward from only a segment of the asymmetric edge on a major axis of the ellipse for inhibiting rotation of the washer and an axially symmetric tapered surface immediately surrounding the central hole for engaging a tapered portion of a tool holder bore, the front surface including a ring shaped elevated portion between the inner and outer edges.

14. The washer of claim 13 wherein the inner edge includes a smooth surface inner bore facilitating rotation of articles within the bore relative to the washer.

15. The washer of claim 13 wherein the lip comprises a linear rearward extension along an outer edge of the back surface of the washer.

16. The washer of claim 13 wherein the washer front surface includes an outer tapered portion and an inner tapered portion, both tapered portions tapering away from the ring shaped elevated portion.

17. The washer of claim 16 wherein the outer tapered portion is larger than the inner tapered portion.

* * * * *